US008515109B2

(12) United States Patent
Dittberner et al.

(10) Patent No.: US 8,515,109 B2
(45) Date of Patent: Aug. 20, 2013

(54) HEARING AID WITH BEAMFORMING CAPABILITY

(75) Inventors: Andrew Dittberner, Antioch, IL (US); Rob De Vries, Tilburg (NL); Almer Jacob Van Den Berg, Eindhoven (NL)

(73) Assignee: GN Resound A/S, Ballerup (DK)

( * ) Notice: Subject to any disclaimer, the term of this patent is extended or adjusted under 35 U.S.C. 154(b) by 496 days.

(21) Appl. No.: 12/621,946

(22) Filed: Nov. 19, 2009

(65) Prior Publication Data

US 2011/0116666 A1 May 19, 2011

(51) Int. Cl.
*H04R 25/00* (2006.01)

(52) U.S. Cl.
USPC ..... 381/313; 381/312

(58) Field of Classification Search
USPC ..... 381/317, 318, 313, 312
See application file for complete search history.

(56) References Cited

U.S. PATENT DOCUMENTS 6,115,478 A * 9/2000 Schneider ..... 381/314
6,385,323 B1 * 5/2002 Zoels ..... 381/313
7,274,794 B1 * 9/2007 Rasmussen ..... 381/92
2004/0047474 A1 3/2004 De Vries et al.
2008/0253596 A1 * 10/2008 Klinkby et al. ..... 381/313
2009/0285423 A1 * 11/2009 Fischer et al. ..... 381/313
2009/0304187 A1 * 12/2009 Dittberner ..... 381/23.1
2011/0044481 A1 * 2/2011 Marquis et al. ..... 381/313

OTHER PUBLICATIONS

P.P. Vaidyanathan, "Multirate Systems and Filter Banks" Prentice-Hall (Series in Signal Processing) Section 3.6, PTR, 1993 (ISBN 0-13-605718-7), pp. 84-92.

* cited by examiner

*Primary Examiner* — Duc Nguyen
*Assistant Examiner* — Phan Le
(74) *Attorney, Agent, or Firm* — Vista IP Law Group, LLP

(57) ABSTRACT

A hearing aid includes a first microphone for providing a first audio input signal, a second microphone for providing a second audio input signal, a signal processor configured for generating a hearing loss compensated audio output signal based at least in part on the audio input signals, and a receiver for converting the audio output signal into an output sound signal, wherein the signal processor is configured to perform directional processing, based on the first and second audio input signals, in a first frequency range and substantially omni-directional processing in a second frequency range, at least a part of the first frequency range being higher than the second frequency range, and wherein a lower cutoff frequency of the first frequency range is adjustable.

21 Claims, 5 Drawing Sheets

HEARING AID WITH BEAMFORMING CAPABILITY

FIELD

One aspect of the application relates to a hearing aid, especially a hearing aid with beamforming capability. Another aspect of the application pertains to a binaural hearing aid system, comprising two hearing aids, employing binaural beamforming.

BACKGROUND

One of the most important tasks for modern hearing aids is to provide improvement in speech intelligibility in the presence of noise. For this purpose, beamforming, especially adaptive beamforming, has been widely used in order to suppress interfering noise. Traditionally, the user of a hearing aid is given the possibility of changing between a directional and a omni-directional mode in the hearing aid (e.g. the user simply changes processing modes by flipping a toggle switch or pushing a button on the hearing aid to put the device in the preferred mode according to the listening conditions encountered in a specific environment). Recently, even automatic switching procedures for switching between directional and omni-directional modes have been employed in hearing aids.

Both omni-directional and directional processing offer benefits relative the other mode, depending upon the specific listening situation. For relatively quiet listening situations, omni-directional processing is typically preferred over the directional mode. This is due to the fact that in situations, where any background noise present is fairly low in amplitude, the omni-directional mode should provide a greater access to the full range of sounds in the surrounding environment, which may provide a greater feeling of "connectedness" to the environment, i.e. being connected to the outside world. The general preference for omni-directional processing when the signal source is to the side or behind the listener is predictable. By providing greater access to sound sources that the listener is not currently facing, omni-directional processing will improve recognition for speech signals arriving from these locations (e.g., in a restaurant where the server speaks from behind or from the side of the listener). This benefit of omni-directional processing for target signals arriving from locations other than in front of the listener will be present in both quiet and noisy listening situations. For noisy listening conditions where the listener is facing the signal source (e.g., the talker of interest), the increased SNR provided by directional processing for signals coming from the front is likely to make directional processing preferred. Each of the listening conditions just mentioned (in quiet, in noise with the hearing aid user facing or not facing the talker) occur frequently in the everyday experience of hearing-impaired listeners. Thus, hearing aid users regularly encounter listening situations where directional processing will be preferable to the omnidirectional mode, and vice versa.

A problem with the approach of manual switching between omni-directional and directional modes of the hearing aid is that listeners may not be aware that a change in mode could be beneficial in a given listening situation if they do not actively switch modes. In addition, the most appropriate processing mode can change fairly frequently in some listening environments and the listener may be unable to conveniently switch modes manually to handle such dynamic listening conditions. Finally, many listeners may find manual switching and active comparison of the two modes burdensome and inconvenient.

As a result, they may leave their devices in a default omni-directional mode permanently.

However, whether directional microphones are chosen manually by the listener or automatically by the hearing instrument, directional processing is performed by a lossy coding of the sound. Basically directional processing consists of spatial filtering where one sound source is enhanced (usually from 0 degrees) and all other sound sources are attenuated. Consequently, the spatial cues are destroyed. Once this information is removed, it is no longer available or retrievable by the hearing aid or the listener. Thus, one of the major problems with such methods of manual or automatic switching between directional and omni-directional modes is the elimination of information, which occurs when the hearing instrument is switched to a directional mode, which may be important to the listener.

Though the purpose of a directional mode is to provide a better signal-to-noise ratio for the signal of interest, the decision of what is the signal of interest is ultimately the listener's choice and cannot be decided upon by the hearing instrument. As the signal of interest is assumed to occur in the look direction of the listener any signal that occurs outside the look direction of the listener can and will be eliminated by the directional processing. This is in compliance with clinical experience, which suggests that automatic switching algorithms currently being marketed are not achieving wide acceptance. Patients generally prefer to switch modes manually rather than to rely on the decisions of these algorithms.

SUMMARY

It is thus an object to provide a hearing aid system by which it is possible to give the user the benefits of both directional and omni-directional modes simultaneously.

One or more of the above mentioned and other objects are achieved by a first aspect of a hearing aid comprising:

a first microphone for converting sound into a first audio input signal, a second microphone for converting sound into a second audio input signal, a signal processor configured for generating a hearing loss compensated audio output signal, based at least in part on the audio input signals, a receiver for converting the audio output signal into an output sound signal, the signal processor being configured to perform directional processing, based on the first and second audio input signals, in a first frequency range and substantially omni-directional processing in a second frequency range, at least a part of the first frequency range being higher than the second frequency range, wherein a lower cutoff frequency of the first frequency range is adjustable.

In some embodiments, any processing that is not directional processing may be considered to be substantially omni-directional processing. In other embodiments, a processing is considered substantially omnidirectional if the corresponding response deviates from a complete 100% omnidirectional response by no more than 30%, and more preferably, by no more than 10%.

Natural auditory localization is based on several so called binaural cues (also called localization cues), the most basic being the differences in time and level between the two ears (interaural time and level differences: ITD and ILD, respectively). ITDs are only resolvable below a particular frequency, and ILDs are only salient above a particular frequency. This phenomenon, known as the duplex theory of sound localization, has a time-intensity frequency region that ranges from approximately 1000 Hz-2000 Hz. Despite this transfer, ITD cues dominate localization, and even affect high frequency localization cues through interaural envelope differences.

Localization ability of hearing-impaired populations is affected by pathology, but in general it is slightly worse than for normal hearing populations. More importantly, recent studies has shown the important finding that when hearing impaired persons performed the same tests with amplification, i.e. when they were wearing a working hearing aid, their localization ability was worse. Thus, in order to maintain the dominant localization cues, a hearing aid must affect the phase characteristics of the incoming low frequency sound as little as possible. As hearing aid compression can adversely affect ILD information, the stability of low frequency ITD information is paramount. These advantages are achieved with a hearing aid as described above according to some embodiments, because by only performing directional processing in the first frequency range, and substantially omni-directional processing in the second frequency range, the low frequency localization cues are not destroyed. This will give the user a clear benefit of increased signal to noise ratio (SNR) in the higher frequency region (the first frequency range) due to the directional processing, while at the same time preserving the low frequency localization cues. This will be a great advantage for most hearing aid users; because the most common hearing impairment is a frequency dependent hearing loss that is increasingly more pronounced in dependence of increasing frequency (this is sometimes referred to as a ski-slope type of hearing loss, or simply age related hearing loss). This means that many hearing impaired persons will have a genuine advantage of directional processing in the higher frequencies, due to the increased SNR. This increased SNR in the higher frequency region is achieved with a hearing aid according to some embodiments, due to the directional processing in the first frequency range. Also, since substantially omni-directional processing is performed in the (lower) second frequency range the most important localization cues are preserved. Thus, giving the benefits of both omni-directional processing (preservation of localization cues), and directional processing simultaneously. Moreover, by having an adjustable lower cutoff frequency of the first frequency range it is possible to individualize the frequency range in which the directional processing is performed to a particular user and thereby taking due case of his/her individual needs.

By the term lower cutoff frequency is understood as a lower endpoint in the first frequency range, for example if the first frequency range is facilitated by the implementation of a band-pass filter.

At least a part of the first frequency range is being higher than the second frequency range. Preferably, the first and second frequency ranges are complementary. However, in one embodiment they may be overlapping and in another embodiment the first and second frequency ranges may be disjoint, i.e. at least non-overlapping, and especially having a frequency range in between them that does not belong to either the first or the second frequency range.

Additionally, the higher cutoff frequency of the second frequency range may be adjustable.

In one embodiment, the lower cutoff frequency of the first frequency range is substantially identical to the higher cutoff frequency of the second frequency range. Especially, if the hearing aid comprises a band-split filter for implementing the first and second frequency ranges, then the lower cutoff frequency of the first frequency range and the higher cutoff frequency of the second frequency range may simply be implemented as the cross-over frequency between two neighbouring bands of the band-split filter.

In some embodiments, the lower cutoff frequency is considered to be substantially identical to the higher cutoff frequency if they do not differ by more than 10%, and more preferably, if they do not differ by more than 5%.

Preferably, the lower cutoff frequency of the first frequency range may be adjusted in dependence of the hearing loss of a user of the hearing aid. For example if the user's hearing loss is of such a character that the hearing threshold starts to increase rapidly at a lower frequency it may be expected that that particular user may benefit from directional processing in a larger frequency region than those whose hearing threshold starts to increase rapidly at a higher frequency, especially such a user will benefit from a lower cutoff frequency of the first frequency range.

In one embodiment the lower cutoff frequency of the first frequency range may be adjusted in dependence of a classification of the ambient sound environment of the hearing aid. This classification is preferably performed on-line, i.e. substantially real time during normal use of the hearing aid. Alternatively, this classification is performed periodically during use of the hearing aid.

In yet another embodiment the lower cutoff frequency of the first frequency range may, during use, bee adjustable in response to a user input. This could for example be achieved by the provision of an actuator on a housing of the hearing aid, which may be operated by the user. This actuator may for example be a switch, e.g. a toggle switch, a wheel, or a push button. Alternatively, the user input may be provided by a signal from a remote control, which the user may operate.

In present day hearing aids there are generally 4 main types (in which the embodiments described herein may be employed): Behind The Ear (BTE) hearing aids, wherein the energy supply, signal processor and other hearing aid circuitry along with the microphone and receiver is placed in a housing that is adapted for being worn behind the ear of a user. The sound produced by the receiver is then transferred to the ear by a sound tube having a sound outlet, which sound outlet is retained in the ear by an earpiece, such as a conventional custom made earmold or a dome. BTE hearing aids also exist in another variant, namely as a so called Receiver In the Ear (RIE) hearing aid, wherein the receiver is placed in the earpiece and is electrically connected to the hearing aid circuitry in the behind the ear housing by a wire. Another widely used hearing aid type is the so called In The Ear (ITE) hearing aid type, which may be standard or custom made, wherein all of the hearing aid circuitry including power supply and receiver is placed in a housing that is adapted for being inserted into the ear canal of a user and which housing may also protrude into the cavum conchae of the user. Another widely used variant of ITE hearing aids are the so called Completely In the Canal (CIC) hearing aids, which essentially are similar to the ITE type, but wherein the whole hearing aid is configured for being placed completely in the ear canal of a user, i.e. not protruding into the cavum conchae of the user. The amount of sound pressure that is possible to build up in the ear canal of a user depends heavily on how tight the earpiece, of e.g. a BTE or RIE, or housing of a BTE or CIC hearing aid seals the ear canal. The sound pressure achievable is thus strongly dependent on the openness of the hearing aid, i.e. on how much of the sound that may escape from within the ear canal and out of it. This openness as mentioned above depends of many factors, such as the type of hearing aid or earpiece used, and on the length and size of a vent opening in the hearing aid (custom made as well as standard hearing aids and earpieces are made often equipped with a vent opening in order to preclude the so called occlusion effect). In this context it is important to note that it is mainly the low frequency sounds that will escape due to an open fitting or the provision of a vent opening. Thus, in a preferred embodiment, the lower cutoff frequency of the first frequency range may be adjusted in dependence of the openness of the hearing aid or the insertion loss of the hearing aid. This is preferably done during fitting of the hearing aid to a specific user, e.g. at a dispenser's office. Hereby it is achieved to take due care of the form factors of the hearing aid used, when it is employed in a particular user.

In addition to this or as an alternative to this, the lower cutoff frequency of the first frequency range may be adjusted in dependence of a user preference during a fitting of the hearing aid.

Recent scientific investigations have shown that most hearing impaired persons have a difference in the SNR loss between the two ears. This was even true for test subjects which had a substantially symmetrical hearing loss, i.e. symmetrical audiogram thresholds for the two ears. This suggests that a person's SNR loss may influence the localization cues. Thus, in one embodiment the lower cutoff frequency of the first frequency range may be adjusted in dependence of the SNR loss of a user of the hearing aid. The term SNR loss is in one embodiment defined as the average increase in signal-to-noise ratio (SNR) needed for a hearing impaired patient relative to a normal hearing person in order to achieve similar performance (50 percent word recognition) on a hearing in noise test, at levels above the hearing threshold. SNR loss may be estimated by measuring a speech reception threshold (SRT) of the hearing impaired individual. An individual's SRT is the signal-to-noise ratio required in a presented signal to achieve 50 percent correct word recognition in a hearing in noise test. Further information on the SNR loss and how it may be evaluated and even compensated for may be found in US 2004/0047474, which is hereby incorporated by reference in its entirety.

According to one embodiment, the beamformer may have one preferred direction. For example defined by the "front look" direction of the user of the hearing aid system, i.e. according to one embodiment, the directional characteristic of the first audio signal may have a direction that is predefined to be in the "front look" direction. Thus, defining a beam in the "front look" direction. While keeping the beam direction fixed the "width" of the beam or shape of the spatial directional characteristic of the first audio signal may according to an alternative embodiment be adaptable or at least adjustable.

According to a preferred embodiment the directional processing may be performed by an adaptive beamformer, i.e. the beamformer optimizes the signal to noise ratio in dependence of the specific situation. By using an adaptable beamformer is furthermore achieved a very flexible solution, wherein it is possible to focus on a moving sound source or to focus on a non-moving sound source, while the user is moving (and thereby the hearing aid system is moving). Furthermore, it is possible to better handle changes in the ambient noise conditions (e.g. appearance of a new sound source, disappearance of a noise source or movement of the noise sources relative to the user of the hearing aid system).

The hearing aid according to the first aspect may in one embodiment be configured for forming part of a binaural hearing aid system comprising another hearing aid.

A second aspect of the embodiments pertains to a binaural hearing aid system, comprising: a first hearing aid that comprises: a first microphone for converting sound into a first audio input signal, a signal processor configured for processing at least a part of the audio input signals in accordance with a hearing loss of the user of the hearing aid, a first receiver for converting an audio output signal into an output sound signal. A second hearing aid that comprises: a second microphone for converting sound into a second audio input signal. Wherein the first hearing aid is adapted to receive the second audio input signal via a communication link between the first and second hearing aid, and wherein the signal processor being configured to perform directional processing, based on the first and second audio input signals, in a first frequency range and substantially omni-directional processing in a second frequency range, at least a part of the first frequency range being higher than the second frequency range, wherein a lower cutoff frequency of the first frequency range is adjustable.

This has among other things the advantage of increased spatial resolution of the beamformer, because the distance between the ears of an average grown up person wearing the first and second hearing aids in or at the ears, is roughly on the order of the wavelength of sound in the audible range. This will thus make it possible to distinguish between spatially closely located sound sources.

According to a preferred embodiment of the binaural hearing aid system, each of the first and second hearing aids comprises an additional microphone that is connected to the beamformer. Hereby is achieved a binaural hearing aid system that will be able to handle several noise sources at one time, and consequently achieve better noise suppression.

According to one embodiment of the second aspect, a higher cutoff frequency of the second frequency range may be adjustable.

According to even another embodiment of the second aspect, the lower cutoff frequency of the first frequency range may be substantially identical to the higher cutoff frequency of the second frequency range.

The lower cutoff frequency of the first frequency range may according to one embodiment of the second aspect be adjusted in dependence of the hearing loss of a user of the hearing aid.

The lower cutoff frequency of the first frequency range may according to even another embodiment of the second aspect be adjusted in dependence of a classification of the ambient sound environment of the hearing aid.

In one embodiment of the second aspect the lower cutoff frequency of the first frequency range may, during use, be adjustable in response to a user input.

The lower cutoff frequency of the first frequency range may according to an embodiment of the second aspect be adjusted in dependence of the openness of the hearing aid or the insertion loss of the hearing aid.

According to an embodiment of the binaural hearing aid system according to the second aspect, the lower cutoff frequency of the first frequency range may be adjusted in dependence of a user preference during a fitting of the hearing aid.

According to an embodiment of the second aspect, the lower cutoff frequency of the first frequency range may be adjusted in dependence of the SNR loss of a user of the hearing aid.

According to another embodiment of the second aspect, the directional processing may be performed by an adaptive beamformer.

A third aspect of the embodiments pertains to a hearing aid comprising: a first microphone for converting sound into a first audio input signal, a second microphone for converting sound into a second audio input signal, a signal processor configured for generating a hearing loss compensated audio output signal, based at least in part on the audio input signals, a receiver for converting the audio output signal into an output sound signal, a bandsplit filter configured for generating at least two high pass audio signals and a low pass audio signal, wherein the at least two high pass audio signals are based on the first and second audio input signals, respectively. The hearing aid further comprises: a beamformer operatively connected to an output of the bandsplit filter, the beamformer being configured for receiving the two high pass audio signals for generating a high frequency beamformed audio signal, a mixer for mixing the low pass audio signal and the high frequency beamformed audio signal, wherein the bandsplit filter has an adjustable cross-over frequency for adjustment of the frequency range of the high pass and low pass audio signals.

Hereby is achieved a simple implementation of a hearing aid, wherein bandsplit filters are used to generate the high pass and low pass audio signals. By the term cross-over frequency of the bandsplit filter is according to one embodiment understood the transitional frequency between the low pass and high pass part of the bandsplit filter.

In one embodiment it is understood that the bandsplit filter may be embodied as a filterbank, comprising at least two filters (a low pass filter and a high pass filter). It is furthermore understood that the low pass filter and/or the high pass filter may be a union of a plurality of filters, which plurality of filters may be overlapping in order to provide smooth transitions at the boundaries.

According to an embodiment of the third aspect, the cross-over frequency may be adjusted in dependence of the hearing loss of a user of the hearing aid.

According to another embodiment of the third aspect, the cross-over frequency may be adjusted in dependence of a classification of the ambient sound environment of the hearing aid.

According to yet another embodiment of the third aspect, the cross-over frequency may, during use, be adjustable in response to a user input.

According to a further embodiment of the third aspect, the cross-over frequency may be adjusted in dependence of the openness of the hearing aid or the insertion loss of the hearing aid.

According to an embodiment of the third aspect, the cross-over frequency may be adjusted in dependence of a user preference during a fitting of the hearing aid.

According to an embodiment of the third aspect, the cross-over frequency may be adjusted in dependence of the SNR loss of a user of the hearing aid.

According to an embodiment of the third aspect, the beamformer may be adaptive.

The hearing aid according to an embodiment of the third aspect may be forming part of a binaural hearing aid system comprising another (possibly similar) hearing aid.

According to one embodiment the mixing of the low pass audio signal and the high frequency beamformed audio signal may be performed according to a soft switching algorithm. This way a smooth transition between the substantially omni-directional low pass audio signal and the high frequency directional, i.e. the high frequency beamformed, audio signal may be achieved.

The soft switching algorithm may in one embodiment comprise the calculation of a mixed signal according to the formula:

$$a*(\text{low pass audio signal})+(1-a)*(\text{high frequency beamformed audio signal}),$$

wherein a is a suitably chosen parameter or function. This way a computationally very simple implementation of a soft switching between the substantially omni-directional low pass audio signal and the high frequency directional, i.e. the high frequency beamformed, audio signal may be achieved.

In a preferred embodiment, a, is a frequency dependent parameter or function. For example a may in one embodiment have values between 1 and 0, wherein a=1 at 0 Hz and 0.5 at the cross-over frequency of the bandsplit filter and 0 at 2*(the cross-over frequency). Preferably, a, is a substantially smooth function with values between 1 at 0 Hz and 0 at 2*(crossover frequency). In yet another embodiment a is a linear function of the frequency, with values between 1 at 0 Hz and 0 at 2*(crossover frequency).

A forth aspect of the embodiments pertains to a hearing aid comprising:

a first microphone for converting sound into a first audio input signal, a second microphone for converting sound into a second audio input signal, a signal processor configured for generating a hearing loss compensated audio output signal, based at least in part on the audio input signals, a receiver for converting the audio output signal into an output sound signal, a first bandsplit filter configured for generating a first high pass audio signal and a first low pass audio signal, based on the first audio input signal, a second bandsplit filter configured for generating a second high pass audio signal and a second low pass audio signal, based on the second audio input signal, a beamformer operatively connected to an output of the first and second bandsplit filters, the beamformer being configured for receiving the first high pass audio signal and the second high pass audio signal for generating a high frequency beamformed audio signal, a mixer for mixing a signal derived from at least one of the first and second low pass audio signals, and the high frequency beamformed audio signal, Each of the first and second bandsplit filters may have an adjustable cross-over frequency for adjustment of the frequency range of the high pass and low pass audio signals.

The cross-over frequency may be adjusted in dependence of the hearing loss of a user of the hearing aid.

In one embodiment the cross-over frequency may be adjusted in dependence of a classification of the ambient sound environment of the hearing aid.

According to one embodiment of the forth aspect the cross-over frequency may, during use, be adjustable in response to a user input.

According to another embodiment the cross-over frequency may be adjusted in dependence of the openness of the hearing aid or the insertion loss of the hearing aid.

According to yet another embodiment of the forth aspect, the cross-over frequency may be adjusted in dependence of a user preference during a fitting of the hearing aid.

The cross-over frequency may, according to one embodiment of the forth aspect, be adjusted in dependence of the SNR loss of a user of the hearing aid.

Preferably, the beamformer may be adaptive in any of the embodiments described herein.

A hearing aid according to an embodiment of the forth aspect may be forming part of a binaural hearing aid system comprising another (possibly similar) hearing aid.

According to an embodiment of the forth aspect, the mixing of the signal derived from at least one of the first and second low pass audio signals, and the high frequency beamformed audio signal may be performed according to a soft switching algorithm. This way a smooth transition between a substantially omni-directional low pass audio signal and the high frequency directional, i.e. the high frequency beamformed, audio signal may be achieved.

According to an embodiment of the forth aspect, the soft switching algorithm may comprise the calculation of a mixed signal according to the formula:

a*(signal derived from at least one of the first and second low pass audio signals)+(1−a)*(high frequency beamformed audio signal), wherein a is a suitably chosen parameter or function. This way a computationally very simple implementation of a soft switching between the substantially omni-directional low pass audio signal and the high frequency directional, i.e. the high frequency beamformed, audio signal may be achieved.

In a preferred embodiment according to the forth aspect, a, is a frequency dependent parameter or function. For example a may in one embodiment have values between 1 and 0, wherein a=1 at 0 Hz and 0.5 at the cross-over frequency of the bandsplit filter and 0 at 2*(the crossover frequency). Preferably, a, is a substantially smooth function with values between 1 at 0 Hz and 0 at 2*(crossover frequency). In yet another embodiment a is a linear function of the frequency, with values between 1 at 0 Hz and 0 at 2*(cross-over frequency).

In accordance with some embodiments, a hearing aid includes a first microphone for providing a first audio input signal, a second microphone for providing a second audio input signal, a signal processor configured for generating a hearing loss compensated audio output signal based at least in part on the audio input signals, and a receiver for converting the audio output signal into an output sound signal, wherein the signal processor is configured to perform directional processing, based on the first and second audio input signals, in a first frequency range and substantially omni-directional processing in a second frequency range, at least a part of the first frequency range being higher than the second frequency range, and wherein a lower cutoff frequency of the first frequency range is adjustable.

In accordance with other embodiments, a binaural hearing aid system includes a first hearing aid that comprises a first microphone for providing a first audio input signal, a signal processor configured for processing at least a part of the audio input signals in accordance with a hearing loss of a user of the hearing aid, and a first receiver for converting an audio output signal into an output sound signal, and a second hearing aid that comprises a second microphone for providing a second audio input signal, wherein the first hearing aid is configured to receive the second audio input signal via a communication link between the first and second hearing aid, and wherein the signal processor is configured to perform directional processing, based on the first and second audio input signals, in a first frequency range and substantially omni-directional processing in a second frequency range, at least a part of the first frequency range being higher than the second frequency range, and wherein a lower cutoff frequency of the first frequency range is adjustable.

In accordance with other embodiments, a hearing aid includes a first microphone for providing a first audio input signal, a second microphone for providing a second audio input signal, a signal processor configured for generating a hearing loss compensated audio output signal based at least in part on the audio input signals, a receiver for converting the audio output signal into an output sound signal, and a bandsplit filter configured for generating at least two high pass audio signals and a low pass audio signal, wherein the at least two high pass audio signals are based on the first and second audio input signals, respectively, wherein the signal processor comprises a beamformer operatively connected to an output of the bandsplit filter, the beamformer being configured for receiving the at least two high pass audio signals for generating a high frequency beamformed audio signal, wherein the signal processor further comprises a mixer for mixing the low pass audio signal and the high frequency beamformed audio signal, and wherein the bandsplit filter has an adjustable cross-over frequency for adjustment of a frequency range of the at least two high pass audio signals and a frequency range of the low pass audio signal.

In accordance with other embodiments, a hearing aid includes a first microphone for providing a first audio input signal, a second microphone for providing a second audio input signal, a signal processor configured for generating a hearing loss compensated audio output signal based at least in part on the audio input signals, a receiver for converting the audio output signal into an output sound signal, a first bandsplit filter configured for generating a first high pass audio signal and a first low pass audio signal based on the first audio input signal, and a second bandsplit filter configured for generating a second high pass audio signal and a second low pass audio signal based on the second audio input signal, wherein the signal processor comprises a beamformer operatively connected to respective outputs of the first and second bandsplit filters, the beamformer being configured for receiving the first high pass audio signal and the second high pass audio signal for generating a high frequency beamformed audio signal, and wherein the signal processor comprises a mixer for mixing a signal derived from at least one of the first and second low pass audio signals, and the high frequency beamformed audio signal.

BRIEF DESCRIPTION OF THE DRAWINGS

In the following, preferred embodiments are explained in more detail with reference to the drawing, wherein.

DESCRIPTION OF THE EMBODIMENTS

Figure 1:
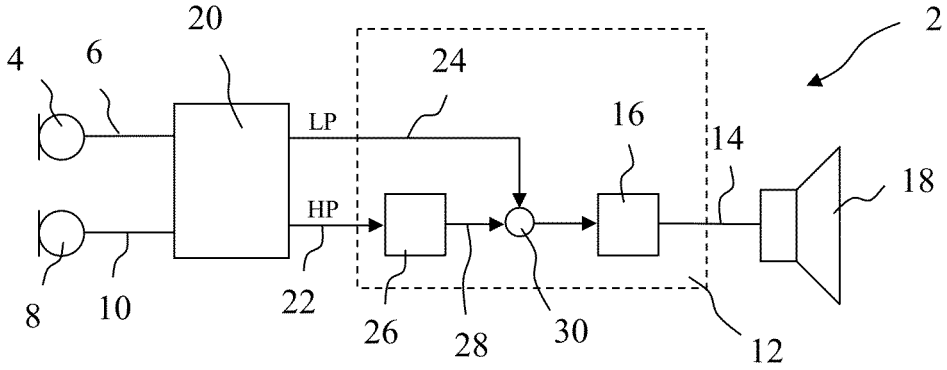
FIG. 1 shows a schematic diagram of an embodiment of a hearing aid.

The embodiments will now be described more fully hereinafter with reference to the accompanying drawings. The claimed invention may, however, be embodied in different forms and should not be construed as limited to the embodiments set forth herein. Thus, the illustrated embodiments are not intended as an exhaustive description of the invention or as a limitation on the scope of the invention. In addition, an illustrated embodiment needs not have all the aspects or advantages shown. An aspect or an advantage described in conjunction with a particular embodiment is not necessarily limited to that embodiment and can be practiced in any other embodiments even if not so illustrated. Like reference numerals refer to like elements throughout.

FIG. 1 shows a schematic diagram of an embodiment of a hearing aid 2. The hearing aid 2 comprises a first microphone 4 for converting sound into a first audio input signal 6, a second microphone 8 for converting sound into a second audio input signal 10. The hearing aid 2 may also comprise analogue to digital converters (not shown) placed in the signal path after the microphones or possibly integrated into the microphones itself. Thus, it is understood that the first and second audio input signals 6, and 10 may be digitized signals. The hearing aid 2 also comprises a signal processor 12 configured for generating a hearing loss compensated audio output signal 14, based at least in part on the audio input signals 6, 10. As used in this specification, the term "processor" is not limited to a single device, and may refer to one or more processing units. Each processing unit may be a processing device, such as a microprocessor, a software, or combination of both. The hearing loss compensation is preferably performed by a compressor 16 (for example such as a compressor as known in the art). The compressor is preferably configured for performing frequency dependent hearing loss compensation, because a hearing loss is almost always frequency dependent. The hearing aid 2 also comprises a receiver 18 for converting the audio output signal 14 into an output sound signal to be presented to a user. The illustrated hearing aid 2 may also comprise a digital to analogue converter (not shown) for converting the audio output signal 14 into an analogue signal prior to feeding it to the receiver 18. Alternatively, such an digital to analogue converter may be an integral part of the receiver 18.

The illustrated hearing aid 2 also comprises a bandsplit filter 20 configured for generating a high pass (HP) audio signal 22 and a low pass (LP) audio signal 24, wherein at least the HP audio signal 22 is based on the first 6 and second 10 audio input signals. Also shown is a beamformer 26 that is operatively connected to an output of the bandsplit filter 20. The beamformer 26 is configured for receiving the HP audio signal 22 for generating a high frequency beamformed audio signal 28. The high frequency beamformed audio signal 28 is thus based on the HP parts of the two audio input signals 6 and 10. The LP audio signal 24 is mixed with the high frequency beamformed audio signal 28 in a mixer 30, which mixer 30 in the illustrated embodiment is a simple adder.

The illustrated bandsplit filter 20 may have an adjustable cross-over frequency for adjustment of the frequency range of the high pass and low pass audio signals 22 and 24.

Figure 2:
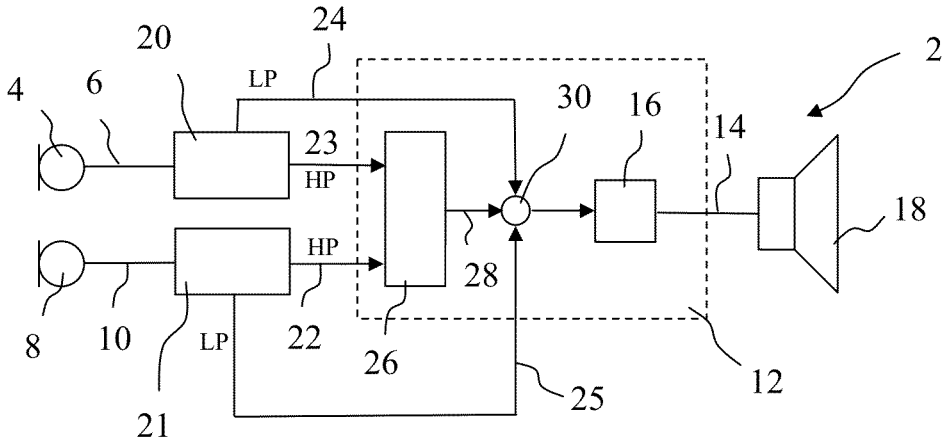
FIG. 2 shows a schematic diagram of an embodiment of a hearing aid.

FIG. 2 shows a schematic diagram of another embodiment of a hearing aid 2. The illustrated hearing aid 2 is fairly similar to the one shown in FIG. 1, and for those elements that are similar in the two figures they may have the same function and the corresponding description of those elements may also apply to the embodiment shown in FIG. 2 in so far that this description is compatible with the other features of the embodiment shown in FIG. 2. The illustrated hearing aid 2 comprises a first microphone 4 for converting sound into a first audio input signal 6, a second microphone 8 for converting sound into a second audio input signal 10, a signal processor 12 configured for generating a hearing loss compensated audio output signal 14, based at least in part on the audio input signals 6, 10. The hearing aid 2 also comprises a receiver 18 for converting the audio output signal 14 into an output sound signal. Instead of one bandsplit filter as shown in FIG. 1, the hearing aid shown in FIG. 2 comprises two bandsplit filters 20 and 21. The first bandsplit filter 20 is configured for generating a first high pass audio signal 23 and a first low pass audio signal 24, based on the first audio input signal 6. The second bandsplit filter 21 is configured for generating a second high pass audio signal 22 and a second low pass audio signal 25, based on the second audio input signal 10.

A beamformer 26 is operatively connected to an output of the first and second bandsplit filters 20 and 21. The beamformer 26 is configured for receiving the first high pass audio signal 23 and the second high pass audio signal 22. From these two high pass audio signals 23 and 22 the beamformer 26 generates a high frequency beamformed audio signal 28. The hearing aid 2 also comprises a mixer 30 for mixing a signal derived from at least one of the first and second low pass audio signals 24 and 25, and the high frequency beamformed audio signal 28. In the illustrated embodiment the first and second LP audio signals 24 and 25 are simply added to the high frequency beamformed audio signal 28. However, in an alternative embodiment at least one of the two LP audio signals 24 and 25 may be subjected to some kind of scaling before they are added to the high frequency beamformed signal 28.

Preferably, each of the first and second bandsplit filters 20 and 21 has an adjustable cross-over frequency for adjustment of the frequency range of the high pass (23 and 22) and low pass (24 and 25) audio signals.

Figure 3:
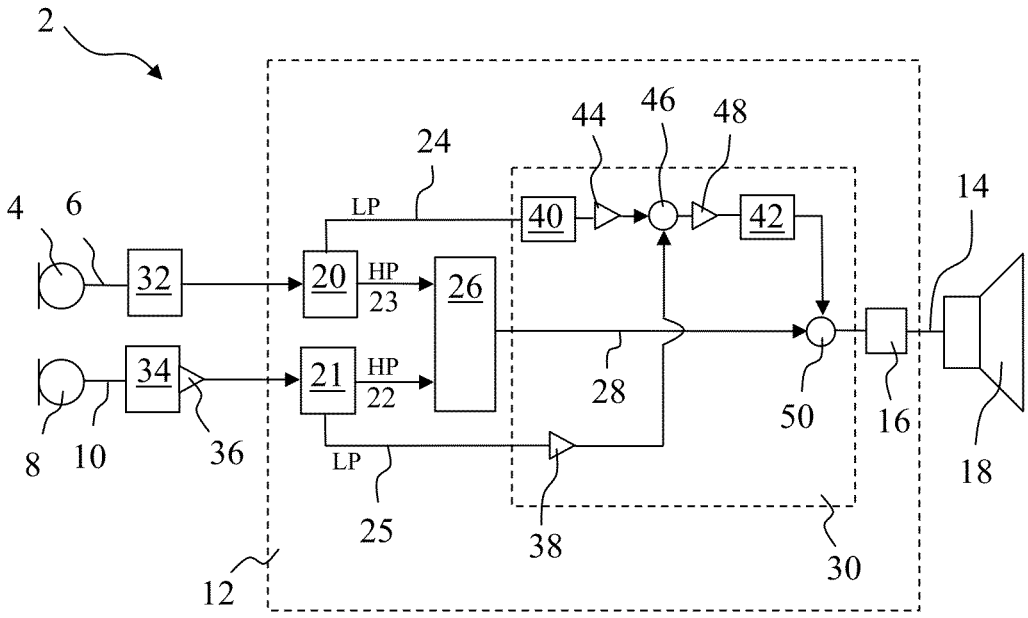
FIG. 3 shows a schematic diagram of an embodiment of a hearing aid.

FIG. 3 shows a schematic diagram of a preferred embodiment of a hearing aid 2. The illustrated hearing aid 2 is fairly similar to the one shown in FIG. 2, and for those elements that are similar in the two figures they may have the same function and the corresponding description of those elements may also apply to the embodiment shown in FIG. 3 in so far that this description is compatible with the other features of the embodiment shown in FIG. 3. The illustrated hearing aid 2 comprises a first microphone 4 for converting sound into a first audio input signal 6, a second microphone 8 for converting sound into a second audio input signal 10. The hearing aid 2 may also comprise analogue to digital converters (not shown) placed in the signal path after the microphones or possibly integrated into the microphones itself. Thus, it is understood that the first and second audio input signals 6, and 10 may be digitized signals.

The illustrated hearing aid 2 also comprises a signal processor 12 configured for generating a hearing loss compensated audio output signal 14, based at least in part on the audio input signals 6, 10. The hearing loss compensation is preferably performed by a compressor 16 (for example such as a compressor as known in the art). The compressor is preferably configured for performing frequency dependent hearing loss compensation, because a hearing loss is almost always frequency dependent. The hearing aid 2 also comprises a receiver 18 for converting the audio output signal 14 into an output sound signal. The illustrated signal processor 12 is embodied as a fixed point digital processor (DSP), but could in an alternative embodiment be a floating point DSP.

One of the microphones, say the first microphone 4 is in one embodiment a front microphone, and the other (microphone 8) is in this embodiment a rear microphone 8.

The sampled audio input signal 6 is feed to a front end filter 32, and the sampled audio input signal 10 is feed to a microphone matching filter 34, which matches the output frequency response of the rear microphone 8 to the one of the front microphone 4. The microphone matching filter 34 could in one embodiment be a so called fixed microphone matching filter known in the art. The output of the microphone matching filter 34 is multiplied with 0.5 in the multiplier 36. This is an implementation specific scaling value of 0.5 due to the use of a fixed point DSP 12, and could in other embodiments be different.

The hearing aid 2 shown in FIG. 3 comprises two bandsplit filters 20 and 21. The first bandsplit filter 20 is configured for generating a first high pass audio signal 23 and a first low pass audio signal 24, based on the first audio input signal 6. The second bandsplit filter 21 is configured for generating a second high pass audio signal 22 and a second low pass audio signal 25, based on the second audio input signal 10.

A beamformer 26 is operatively connected to an output of the first and second bandsplit filters 20 and 21. The beamformer 26 is configured for receiving the first high pass audio signal 23 and the second high pass audio signal 22. From these two high pass audio signals 23 and 22 the beamformer 26 generates a high frequency beamformed audio signal 28.

The hearing aid 2 also comprises a mixer 30 for mixing a signal derived from at least one of the first and second low pass audio signals 24 and 25, and the high frequency beamformed audio signal 28. The illustrated mixer 30 comprises a multiplier 38 for scaling the first LP audio signal 24. In a preferred embodiment the multiplier 38 multiplies the first LP audio signal with the value 1.0. The illustrated mixer 30 also comprises a time delay 40 for delaying the samples of that signal path in order to compensate for the time delay introduced by the microphone matching filter 34. In the signal path after the time delay 40 is placed a multiplier 44, which multiplies the delayed samples with the value 0.5. This multiplier 44 is needed because the output of the microphone matching filter 34 was multiplied with 0.5 using the multiplier 36.

The delayed (in delay 40) and scaled (by multiplier 44) first LP audio signal 24 is added to the scaled (by multiplier 38) second LP audio signal 25 in the adder 46. This makes it possible to account for uncorrelated noise in the two LP audio signals 24 and 25 in a simple and efficient manner.

The combined LP audio signal (output of the adder 46) is delayed by the time delay 42 in order to compensate for the time delay introduced by the beamformer 26, before it is added to the beamformed audio output signal 28 in the adder 50. In the illustrated embodiment the output of the adder 50 thus represents a full bandwidth audio signal, wherein the lower frequencies have an omni-directional response and wherein the higher frequencies have a directional response. The output signal from the adder 50 is then feed to the compressor 16, which operates on the output signal of the adder 50 in order to generate a hearing loss compensated audio output signal 14. The illustrated hearing aid 2 may also comprise a digital to analogue converter (not shown) for converting the audio output signal 14 into an analogue signal prior to feeding it to the receiver 18. Alternatively, such an digital to analogue converter may be an integral part of the receiver 18.

The illustrated mixer 30 also comprises a multiplier 48, which is inserted in the signal path between the adder 46 and the time delay 42. The multiplier 48 multiplies the output signal of the adder 46 with a, preferably programmable, value that may be chosen to be any value between 0.0 and 1.0. By altering the value via for example the fitting software in a fitting situation it is possible to adjust the amplitude value of the low frequencies, i.e. the amplitude level of the (combined) LP audio signals 24 and 25.

It is understood that in an alternative embodiment of the hearing aid 2 illustrated in FIG. 3, any (possibly all) of the multipliers 36, 38, 44 and 48 can be avoided altogether, for example depending on what kind of DSP is used.

In a preferred embodiment the first bandsplit filter 20 and the second bandsplit filter 21 are substantially identical.

The DSP 12 shown in FIG. 3 could in an alternative embodiment also comprise the filters 32 and 34. Furthermore, the illustrated DSP could in yet an alternative embodiment be implemented without the bandsplit filters 20 and 21.

Preferably, each of the first and second bandsplit filters 20 and 21 has an adjustable cross-over frequency for adjustment of the frequency range of the high pass (23 and 22) and low pass (24 and 25) audio signals.

Figure 4:
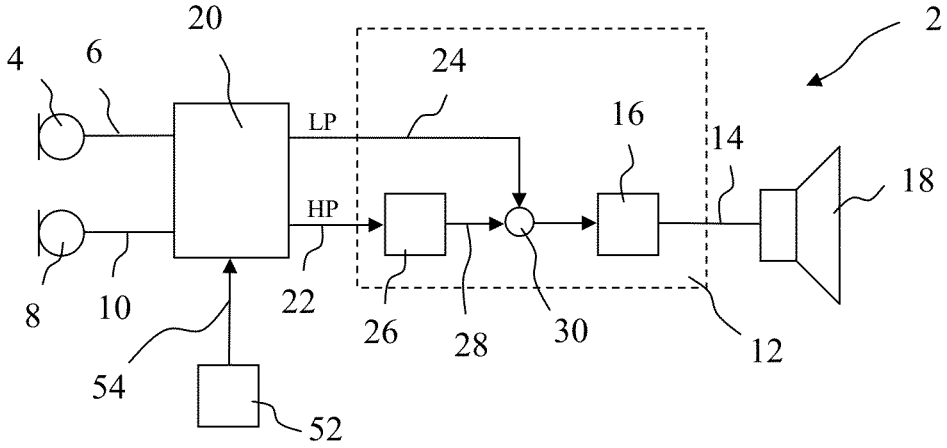
FIG. 4 shows a schematic diagram of an embodiment of a hearing aid.

FIG. 4 shows a schematic diagram of an embodiment of a hearing aid 2. The hearing aid 2 is very similar to the one shown in FIG. 1. Thus, only the differences to the hearing aid 2 shown in FIG. 1 will be explained further. The illustrated hearing aid 2 is equipped with a user interface 52, which is operatively connected to the bandsplit filter 20 as indicated by the arrow 52. Via the user interface 50, the user may adjust the cross-over frequency of the bandsplit filter. Hereby is achieved that the lower cutoff frequency of the first frequency range may, during use, bee adjustable in response to a user input. Especially, is achieved that the user during use may adjust the frequency range of the HP audio signal 22 as well as the frequency range of the LP audio signal 24 during use of the hearing aid 2. This provides the user with the unique opportunity to be able to adjust how much of the microphone signal needs to be subjected to directional signal processing in dependence of the given outer acoustic situation, and thereby perform a trade-off between desired SNR versus how much the user wants to "feel connected" to the ambient sound environment. This need can vary significantly from situation to situation.

The user interface 50 could for example be facilitated by the provision of an actuator (not shown) on a housing (not shown) of the hearing aid 2, which may be operated by the user. This actuator may for example be a switch, e.g. a toggle switch, a wheel, or a push button. Alternatively, the user input may be provided by a signal from a remote control, which the user may operate.

The user interface shown in FIG. 4 and described above could also be used together with the any of the embodiments shown in FIG. 2, FIG. 3, FIG. 5, FIG. 6 and FIG. 7, wherein the user interface 50 would be operatively connected to any (preferably both) of the first and second bandsplit filters 20 and 21 in order to provide a user control of the frequency range of the first and second HP audio signals 23 and 22, and the frequency range of the first and second LP audio signals 24 and 25.

Figure 5:
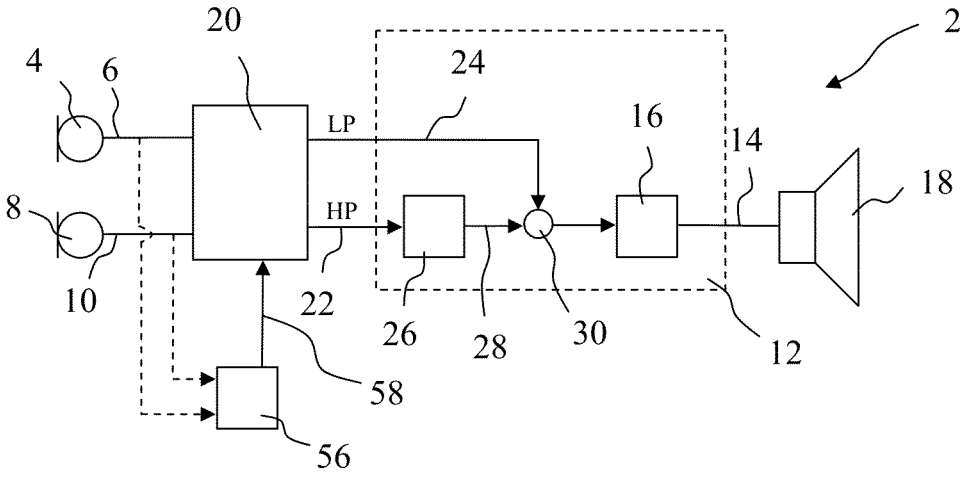
FIG. 5 shows a schematic diagram of an embodiment of a hearing aid.

FIG. 5 shows a schematic diagram of an embodiment of a hearing aid 2. The hearing aid 2 is very similar to the one shown in FIG. 1. Thus, only the differences to the hearing aid 2 shown in FIG. 1 will be explained further. The illustrated hearing aid 2 is equipped with a classifier 56, which is operatively connected to the bandsplit filter 20 as indicated by the arrow 58. The classifier 56 performs a classification of the ambient sound environment of the hearing aid. In the illustrated embodiment, the classifier 56 is connected to the signal path of at least one of the input audio signals 6 and 10. This is indicated by the dashed arrows leading from either of the input audio signal paths 6 and 20 to the classifier 56. The illustrated classifier 56 may for example be a hidden Markov Model classifier, a neural network classifier, a Bayesian classifier, a fuzzy logic machine or simply a speech detector. Based on a classification of the sound environment the classifier 56 adjusts the cross-over frequency of the bandsplit filter 20 so that the frequency ranges of the LP audio signal and the HP audio signal are optimized for the specific prevailing ambient sound environment of the hearing aid 2. For example in a babble-noise type of sound environment it may be beneficial for the user to have an increased SNR in a wider frequency range than in an environment wherein the user communicates with a single person in an place with another type of interfering noise, whereby the classifier imparts to the bandsplit filter 20 a lower cross-over frequency in the first situation.

The classifier 56 shown in FIG. 5 and described above could also be used together with the any of the embodiments shown in FIG. 2-FIG. 4, FIG. 6 and FIG. 7, wherein the classifier 56 would be operatively connected to any (preferably both) of the first and second bandsplit filters 20 and 21 in order to provide a user control of the frequency range of the first and second HP audio signals 23 and 22, and the frequency range of the first and second LP audio signals 24 and 25.

Figure 6:
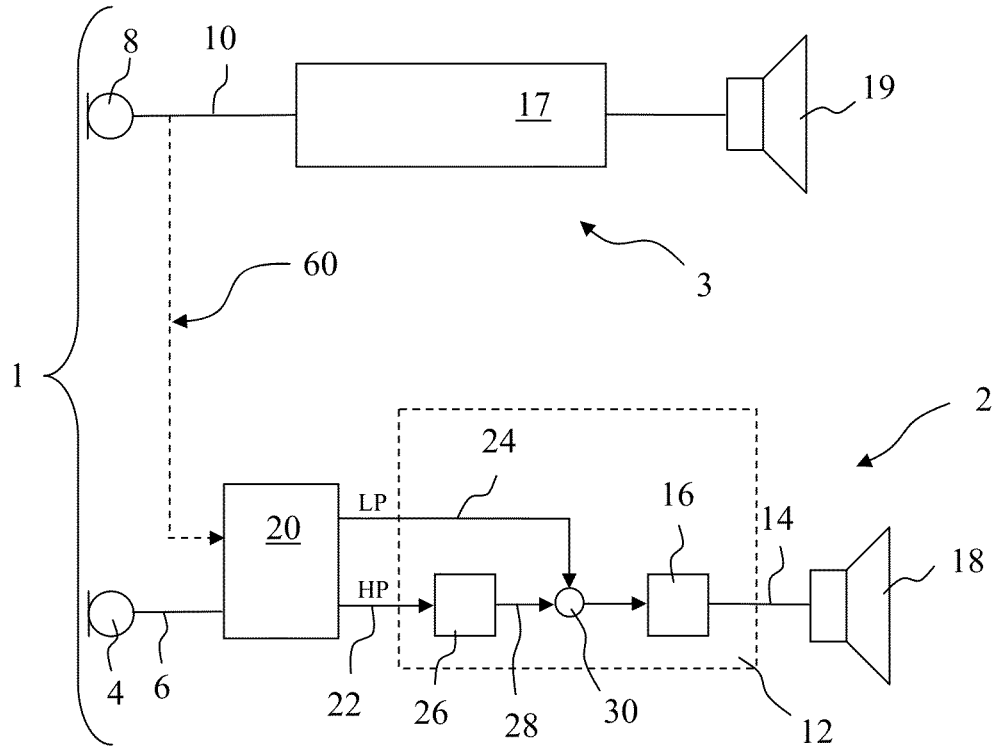
FIG. 6 shows a schematic diagram of an embodiment of a binaural hearing aid.

FIG. 6 shows a schematic diagram of an embodiment of a binaural hearing aid system 1. The binaural hearing aid system 1 comprises a first hearing aid 2 and a second hearing aid 3. The first hearing aid 2 comprises a first microphone 4 for converting sound into a first audio input signal 6, a signal processor 12 configured for processing at least a part of the audio input signal 6 in accordance with a hearing loss, associated with preferably a first ear, of the user of the hearing aid 2, a first receiver 18 for converting an audio output signal 14 into an output sound signal. Generally the hearing aid 2 is very similar to the one shown in FIG. 1. Thus, only the differences to the hearing aid 2 shown in FIG. 1, and the description of the features of the hearing aid 2 shown in FIG. 1 also applies to the hearing aid 2 in so far that they are compatible with the other features of the hearing aid 2 illustrated in FIG. 6.

The illustrated binaural hearing aid system 1 also comprises a second hearing aid 3, which second hearing aid 3 comprises: A second microphone 8 for converting sound into a second audio input signal 10. The second hearing aid 3 also comprises hearing aid circuitry 17, e.g. for processing the audio input signal 10 in accordance with a hearing loss, associated with preferably a second ear, of the user of the hearing aid 3. The hearing aid circuitry 17 thus provides a hearing loss compensated output signal, which is converted to a sound signal in the illustrated receiver 19.

The first hearing aid 2 is adapted to receive the second audio input signal 10 via a communication link 60 between the first 2 and second 3 hearing aid. This communication link 60 could be wired or wireless.

The signal processor 12 is configured to perform directional processing, based on the first and second audio input signals, in a first frequency range and substantially omnidirectional processing in a second frequency range, at least a part of the first frequency range being higher than the second frequency range, wherein a lower cutoff frequency of the first frequency range is adjustable. The first and second frequency ranges may for example be facilitated by a bandsplit filter 20 configured for generating a high pass (HP) audio signal 22 (corresponding to the signal in a first frequency range) and a low pass (LP) audio signal 24 (corresponding to the signal in a second frequency range), wherein at least the HP audio signal 22 is based on the first 6 and second 10 audio input signals. Also shown is a beamformer 26 that is operatively connected to an output of the bandsplit filter 20. The beamformer 26 is configured for receiving the HP audio signal 22 for generating a high frequency beamformed audio signal 28. The high frequency beamformed audio signal 28 is thus based on the HP parts of the two audio input signals 6 and 10. The LP audio signal 24 is mixed with the high frequency beamformed audio signal 28 in a mixer 30, which mixer 30 in the illustrated embodiment is a simple adder. The illustrated bandsplit filter 20 may have an adjustable cross-over frequency (corresponding to the embodiment, wherein the higher and lower cutoff frequencies are identical and equal to the so called cross-over frequency) for adjustment of the frequency range of the high pass and low pass audio signals 22 and 24.

In an alternative embodiment the second hearing aid 3 could be identical to the illustrated hearing aid 2 and the communication link 60 could be bi-directional, so that the first hearing aid 2 is configured to receive the second audio input signal 10 via the communication link 60 as illustrated, and the second hearing aid 3 may be configured to receive the first audio input signal 6 via the communication link 60 and process the first and second audio input signals 6 and 10 in the same manner as described with respect to the first hearing aid 2.

In yet an alternative embodiment either or both of the first and second hearing aids 2 and 3 may be equipped with a second microphone. Preferably, each of the first and second hearing aids 2 and 3 comprises at least two microphones as illustrated in FIG. 7, e.g. a front microphone and a rear microphone.

Figure 7:
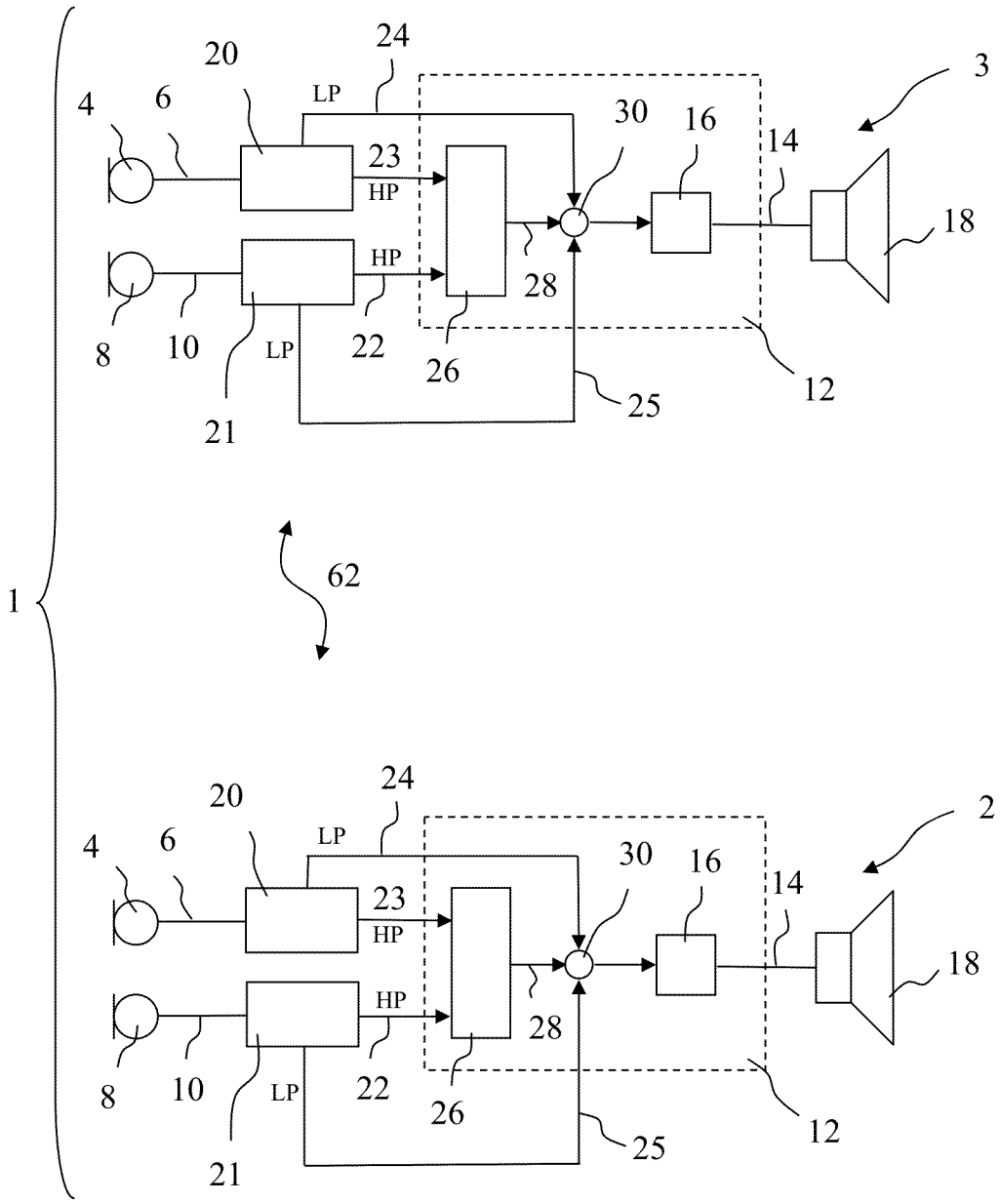
FIG. 7 shows a schematic diagram of an embodiment of a binaural hearing aid.

FIG. 7 shows schematic diagram of an alternative embodiment of a binaural hearing aid system 1. The binaural hearing aid system 1 comprises a first hearing aid 2 and a second hearing aid 3 which are operatively connected to each other via a bidirectional communication link 62. Each of the illustrated first and second hearing aids 2 and 3 are identical to the hearing aid 2 illustrated in FIG. 2 and described above. Therefore, the similar features in the two hearing aids 2 and 3 are designated with the same reference number. In an alternative embodiment it is understood that one or both of the two hearing aids 2 and 3 may be exchanged with anyone of the hearing aids illustrated in FIG. 1, FIG. 3, FIG. 4 or FIG. 5. The difference to the hearing aid 2 illustrated in FIG. 2 and described above is that the bidirectional link 62 enables the two hearing aids to perform coordinated signal processing, especially a coordinated adjustment of the cross-over frequency of the bandsplit filters 20 and 21 in both of the hearing aids 2 and 3. Furthermore, the bidirectional link 62 enables the two hearing aids to exchange audio signals as well as control signals. For example the beamformer 26 of the first hearing aid 2 may also be configured to receive the first and second HP audio signals 23 and 22 generated in the second hearing aid 3. The beamformer 26 in the first hearing aid 2 may thus have access to four audio signals to work on, whereby the performance of it may be increased, because it (the beamformer 26) may be able to handle more noise sources, and due to the distance between the first and second hearing aid 2 and 3 (they will be configured to be worn at or in each ear of a user), the spatial resolution is increased as well. The bidirectional communication link 62 may be wired or wireless.

In any of the embodiments shown in FIGS. 1-7, and described above, the cross-over frequency may be chosen to be any frequency in the range from 200 Hz-8000 Hz, preferably, in the range from 1000 Hz-5000 Hz, even more preferably in the range from 1000 Hz-3000 Hz, and yet even more preferably in the range from 1000 Hz-2500 Hz, such as for example any of the frequencies 500 Hz, 800 Hz, 1000 Hz, 1200 Hz, 1500 Hz, 1800 Hz, 2000 Hz, 2500 Hz, 2800 Hz, 3100 Hz, 3400 Hz, 3700 Hz, 4000 Hz, 4200 Hz, 4500 Hz, or 7500 Hz. Hereby is achieved that the LP audio signal 24 may be chosen to have a frequency range that may be any suitable sub-range of [0 Hz-8 kHz], such as for example [0 Hz-4 kHz], [200 Hz-3500 Hz], [0 Hz-3000 Hz], [0 Hz-200 Hz], [200 Hz-2500 Hz] or [0 Hz-1500 Hz], and many others.

Similarly, in any of the embodiments shown in FIGS. 1-7, and described above, the HP audio signal 22 and/or 23 may be chosen to have a frequency range that may be any suitable sub range of the frequency range from [200 Hz-20 kHz], such as for example [200 Hz-16 kHz], [2500 Hz-12 kHz], [1 kHz-10 kHz], [1500 Hz-8 kHz], [3000 Hz-8 kHz] or [4500 Hz-14 kHz], and many others.

In any of the embodiments shown in FIGS. 1-7, and described above, the bandsplit filter 20 and/or 21 may be embodied as a filterbank, and may comprise a high pass filter and a low pass filter. The high pass filter and low pass filter may be overlapping. It is furthermore understood that the low pass filter and/or the high pass filter may be a union of a plurality of filters, which plurality of filters may be overlapping in order to provide smooth transitions at the boundaries.

In a preferred embodiment, the frequency ranges of the HP audio signal 22 and/or 23 and the LP audio signal 24 and/or 25 are complementary, i.e. the LP audio signal may for example have a frequency range such as [0 Hz-2000 Hz] or [200 Hz-3000 Hz], and the corresponding HP audio signal may for example have a frequency range such as [2000 Hz-8000 Hz] or [3000 Hz-16 kHz]. However, many other configurations are possible, and may be chosen on the basis of some of the criteria's mentioned above and below.

In any of the embodiments shown in FIGS. 1-7, and described above, the illustrated signal processor 12 is preferably a digital signal processor, and the bandsplit filter 20 and/or 21 may in one embodiment be implemented in the signal processor 20.

As mentioned under the section "Summary", the cross-over frequency may, in any of the embodiments shown in FIGS. 1-7, and described above, be adjusted in dependence of the hearing loss of a user of the hearing aid.

Furthermore, In any of the embodiments shown in FIGS. 1-7, and described above, the cross-over frequency may be adjusted in dependence of the openness of the hearing aid or the insertion loss of the hearing aid and/or in dependence of a user preference during a fitting of the hearing aid and/or in dependence of the SNR loss of a user of the hearing aid.

The beamformer 26 may be adaptive, and/or the hearing aid illustrated in any of the FIGS. 1-5 may be adapted for forming part of a binaural hearing aid system comprising another (possibly similar or identical) hearing aid.

One of the microphones 4 or 8 shown in any of the FIG. 1 or 2 may be a placed on the hearing aid 2 such that it during use may be considered as a front microphone and the other a rear microphone.

Figure 8:
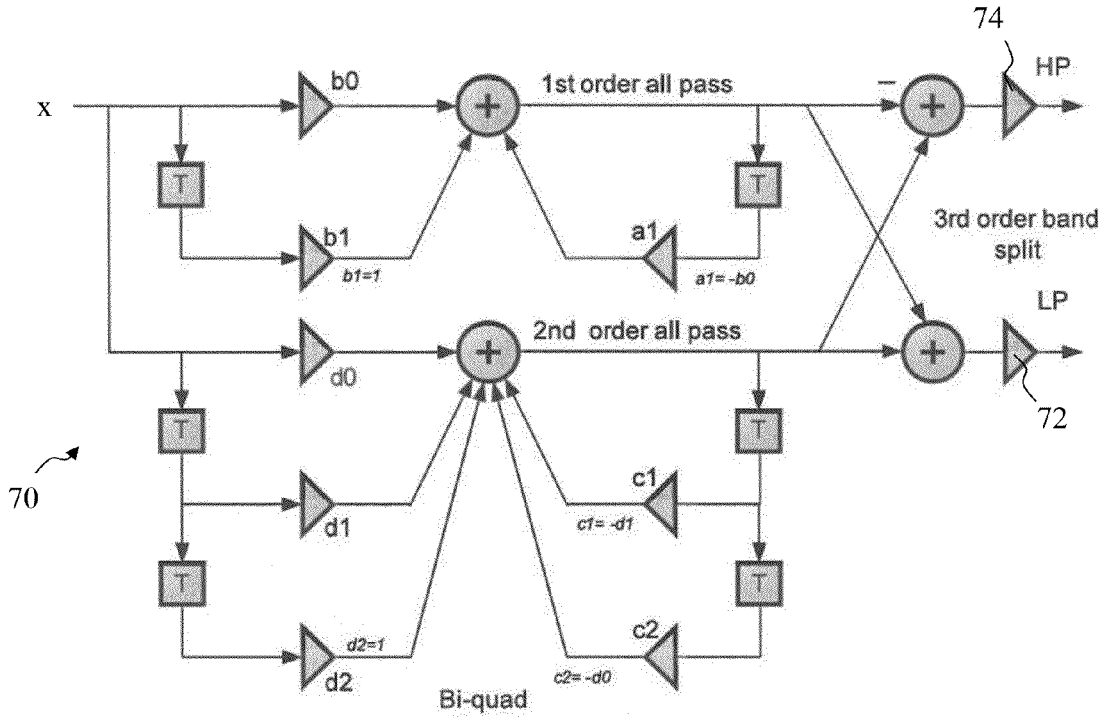
FIG. 8 illustrates a schematic diagram of an embodiment of a bandsplit filter.

FIG. 8 shows schematic illustration of an embodiment of a digital implementation of bandsplit filter 20, 21 as illustrated in any of the FIGS. 1-7. The illustrated bandsplit filter structure 70 is a digital Infinite Impulse response (IIR) filter constructed by two all pass filters, a $1^{st}$ order all pass filter and a $2^{nd}$ order all pass filter whose components are summed to form a high pass audio signal (e.g. the HP audio signal 22 and/or 23) and a low pass audio signal (e.g. the LP audio signal 24 and/or 25). The resultant bandsplit filter 70 has a $3^{rd}$ order roll-off (6 dB/octave). The input to the bandsplit filter 70 is a digitized block based time domain audio input signal (derived from at least one of the audio input signals 6 and 10). The bandsplit filter 70 has as mentioned before two outputs a HP version of the signal x and the LP version of the signal x. The cutoff frequency for the high pass and low pass characteristics is the same and is also denoted cross-over frequency throughout the present patent specification. Hereby is achieved a filter structure having the nice power characteristics that when adding the magnitude spectrum from the LP and HP section together, the result is unity gain over all frequencies. Furthermore, the all pass structure allows for an efficient implementation memory wise and computationally wise. The only input to the bandsplit filter 70 is the cross-over frequency specification (and sampling frequency, naturally), from which all the filter coefficients (embodied as multipliers), a1, b0, b1, c1, c2, d0, d1 and d2 are calculated, e.g. by the fitting software. The T-blocks denote time delays of one sample. The coefficients a1, b0, b1, c1, c2, d0, d1 and d2 determine resulting filter shape, which in this case is a Butterworth filter form (which means that it has a maximally flat magnitude response at the frequencies f=0 and f=fs/2, where fs is the sampling frequency). The LP output signal of the bandsplit filter 70 may be scaled by the use of an (optional) multiplier 72, and correspondingly the HP output signal of the bandsplit filter 74 may be scaled by the use of an (optional) multiplier 74. The derivation of the IIR transfer function from the all pass structure can be found in the book "Multirate Systems and Filter Banks" by P. P. Vaidyanathan, section 3.6 (pages 84-92), Prentice-Hall (Series in Signal Processing), PTR, 1993 (ISBN 0-13-605718-7), said section is herby incorporated by reference.

It is understood that the high pass (HP) audio signal 22 shown in any of the FIG. 1, 4, 5 or 6 is a two-dimensional signal representing the high pass part of each of the first audio input signal 6 and second audio input signal 10. Thus, although only one signal path 22 is shown in FIGS. 1, 4, 5 and 6, this one signal path comprises in fact two signal paths, namely the high pass part of first audio input signal 6 and the high pass part of the second audio input signal 10.

It should be noted that in any of the embodiments described herein, one or more components described with reference to a hearing aid are not required to be physically coupled to the hearing aid. For example, in some embodiments, the processor of a hearing aid may be physically decoupled from the hearing aid. In such cases, the processor may wirelessly communicate with the hearing aid.

Also, in any of the embodiments described herein, a signal described as being provided from a component is not limited to a signal that is directly from that component, and may refer to a signal that is derived from an output of that component. For example, in an embodiment in which component X receives/processes signal s from component Y, the signal s may be an output directly from component Y, or a signal that is derived (e.g., processed, adjusted, modified, etc.) from the output of component Y.

As illustrated above, band limited beamforming together with band limited omni-directional processing based on the use of an adjustable cross-over frequency is implemented in a hearing aid in accordance with some embodiments. However, as will be understood by those familiar in the art, the claimed invention may be embodied in other specific forms and utilize any of a variety of different algorithms without departing from the spirit or essential characteristics thereof. For example the selection of a specific type of bandsplit filter or crossover frequency may typically be application specific, the selection depending upon a variety of factors including the expected processing complexity and computational load. Accordingly, the disclosures and descriptions herein are intended to be illustrative, but not limiting, of the scope of the claimed invention which is set forth in the following claims.

The invention claimed is:

1. A hearing aid comprising:

a first microphone for providing a first audio input signal;

a second microphone for providing a second audio input signal;

a signal processor configured for generating a hearing loss compensated audio output signal based at least in part on the audio input signals; and a receiver for converting the audio output signal into an output sound signal;

wherein the signal processor is configured to perform directional processing, based on the first and second audio input signals, in a first frequency range and substantially omni-directional processing in a second frequency range, at least a part of the first frequency range being higher than the second frequency range, and wherein a lower cutoff frequency of the first frequency range is adjustable.

2. The hearing aid according to claim 1, wherein a higher cutoff frequency of the second frequency range is adjustable.

3. The hearing aid according to claim 2, wherein the lower cutoff frequency of the first frequency range is substantially identical to the higher cutoff frequency of the second frequency range.

4. The hearing aid according to claim 1, wherein the lower cutoff frequency of the first frequency range is adjustable in dependence of the hearing loss of a user of the hearing aid.

5. The hearing aid according to claim 1, wherein the lower cutoff frequency of the first frequency range is adjustable in dependence of a classification of an ambient sound environment of the hearing aid.

6. The hearing aid according to claim 1, wherein the lower cutoff frequency of the first frequency range is adjustable in response to a user input.

7. The hearing aid according to claim 1, wherein the lower cutoff frequency of the first frequency range is adjustable in dependence of an openness of the hearing aid or an insertion loss of the hearing aid.

8. The hearing aid according to claim 1, wherein the lower cutoff frequency of the first frequency range is adjustable in dependence of a user preference during a fitting of the hearing aid.

9. The hearing aid according to claim 1, wherein the lower cutoff frequency of the first frequency range is adjustable in dependence of a SNR loss of a user of the hearing aid.

10. The hearing aid according to claim 1, wherein the processor comprises an adaptive beamformer for performing the directional processing.

11. A binaural hearing aid system comprising:

the hearing aid according to claim 1; and another hearing aid.

12. A binaural hearing aid system, comprising:

a first hearing aid that comprises a first microphone for providing a first audio input signal, a signal processor configured for processing at least a part of the audio input signals in accordance with a hearing loss of a user of the hearing aid, and a first receiver for converting an audio output signal into an output sound signal; and a second hearing aid that comprises a second microphone for providing a second audio input signal;

wherein the first hearing aid is configured to receive the second audio input signal via a communication link between the first and second hearing aid; and wherein the signal processor is configured to perform directional processing, based on the first and second audio input signals, in a first frequency range and substantially omni-directional processing in a second frequency range, at least a part of the first frequency range being higher than the second frequency range, and wherein a lower cutoff frequency of the first frequency range is adjustable.

13. The binaural hearing aid system according to claim 12, wherein a higher cutoff frequency of the second frequency range is adjustable.

14. The binaural hearing aid system according to claim 13, wherein the lower cutoff frequency of the first frequency range is substantially identical to the higher cutoff frequency of the second frequency range.

15. The binaural hearing aid system according to claim 12, wherein the lower cutoff frequency of the first frequency range is adjustable in dependence of a hearing loss of a user of the hearing aid.

16. The binaural hearing aid system according to claim 12, wherein the lower cutoff frequency of the first frequency range is adjustable in dependence of a classification of an ambient sound environment of the hearing aid.

17. The binaural hearing aid system according to claim 12, wherein the lower cutoff frequency of the first frequency range is adjustable in response to a user input.

18. The binaural hearing aid system according to claim 12, wherein the lower cutoff frequency of the first frequency range is adjustable in dependence of an openness of the hearing aid or an insertion loss of the hearing aid.

19. The binaural hearing aid system according to claim 12, wherein the lower cutoff frequency of the first frequency range is adjustable in dependence of a user preference during a fitting of the hearing aid.

20. The binaural hearing aid system according to claim 12, wherein the lower cutoff frequency of the first frequency range is adjustable in dependence of a SNR loss of a user of the hearing aid.

21. The binaural hearing aid system according to claim 12, wherein the processor comprises an adaptive beamformer for performing the directional processing.

* * * * *